US006150939A

United States Patent [19]

Lin

[11] Patent Number: 6,150,939

[45] Date of Patent: Nov. 21, 2000

[54] GARBAGE CONTAINER WITH AUTOMATIC OPENING AND CLOSING FUNCTIONS

[76] Inventor: Chung-Ren Lin, P.O. Box 82-144, Taipei, Taiwan

[21] Appl. No.: 09/238,896

[22] Filed: Jan. 28, 1999

[51] Int. Cl.[7] ..... G08B 13/14

[52] U.S. Cl. ..... 340/568.1; 248/147; 318/480

[58] Field of Search ..... 340/568.1, 565, 340/566, 567; 220/263, 262; 248/147; 318/480; 49/25

[56] References Cited

U.S. PATENT DOCUMENTS

| | | | |
|---|---|---|---|
| 4,981,275 | 1/1991 | Sheu | 248/147 |
| 4,996,467 | 2/1991 | Day | 318/480 |
| 5,329,212 | 7/1994 | Feigleson | 318/480 |
| 5,932,982 | 8/1999 | Pezzelli, Jr. | 318/480 |

*Primary Examiner*—Daniel J. Wu
*Assistant Examiner*—John Tweel, Jr.
*Attorney, Agent, or Firm*—A & J

[57] ABSTRACT

An improved garbage container with automatic opening and closing functions, in particular an improvement directed to large-size garbage container, including an electric-controlled sensing device disposed at an upper end of a garbage container body, and a linking-up device provided at the feed slot of the garbage container. The linking-up device controls opening or closing of movable covers of the feed slot. An electronic eye of the electric-controlled sensing device detects whether a person is approaching the garbage container. When the person is within a predetermined distance, the movable covers will automatically open to allow dumping of garbage therein, without the user's touching the movable covers. After the user has left, the movable covers automatically close to prevent exposure of the garbage and breeding of insects such as mosquitoes and flies.

5 Claims, 9 Drawing Sheets

GARBAGE CONTAINER WITH AUTOMATIC OPENING AND CLOSING FUNCTIONS

BACKGROUND OF THE INVENTION

1. Field of the Invention

The present invention relates generally to a garbage container, and more particularly to an improved garbage container with automatic opening and closing functions.

2. Description of the Prior Art

FIG. 1 shows a conventional garbage container 4, in particular a large-size garbage container for use in buildings. It basically comprises a rectangular container body 40. The container body 40 is formed with a rectangular feed slot 41 having a movable cover 42. The center of the movable cover 42 is provided with a shaft hole 421 for receiving a rotary shaft 411 that pivotally connects the movable cover 42 to the middle of the feed slot 41 of the container body 40, so that the movable cover 42 can turn thereon. On one side of the movable cover 42, there is provided a cigarette groove 43 for snuffing out cigarettes. The opening of the cigarette extinguishing groove 43 has a plurality of partition plates 431 formed thereon, through which users can drop the cigarette ends into the cigarette extinguishing groove 43. The central portion of the container body 40 is configured to be a garbage can 44 that can be pulled out or pushed into the container body 40 along parallel slide rails 401. The garbage can 44 has such a shape that a replaceable garbage bag can be fitted thereon.

In the above-mentioned garbage container, the movable cover 42 is turnable on the feed slot 41 and can be turned on one side to allow dumping of garbage into the garbage can 44. After turning, the movable cover will return to its original substantially level position due to its weight so that it is always covering the feed slot 41 to the interior of the container body 40. However, in actual use, there are the following disadvantages:

1. The user's hand may easily come into direct contact with the garbage container 4, which is not hygienic. When the user dumps light garbage, such as tissue, into the garbage container 4, the user may need to push the movable cover 42 with his hand. And if the user wants to dump garbage from a wastebasket, for instance, and he needs to hold the basket with both hands, it will be very convenient to turn the movable cover 42.

2. The movable cover 42 cannot positively seal the feed slot of the garbage container 4, which may lead to breeding of insects, such as mosquitoes.

The movable cover 42 may sometimes stay in a substantially vertical position or the turning of the rotary shaft 411 may be too tight that the movable cover 42 cannot completely close the feed slot 41. As a result, the bad odor of the garbage may be released to the surroundings, and insects such as mosquitoes, flies may breed, affecting environmental hygiene.

3. It is not possible to know how much garbage has been collected in the garbage container. As conventional garbage containers are not provided with any means to ascertain the amount of garbage inside the garbage container. Oftentimes, the garbage container is full to the top and no one has come to clean up, which is not only unsightly but also troublesome to clean up.

SUMMARY OF THE INVENTION

The present invention relates generally to a garbage container, and more particularly to an improved garbage container with automatic opening and closing functions.

A primary object of the present invention is to provide an improved garbage container with automatic opening and closing functions to eliminate the drawbacks with the prior art.

DETAILED DESCRIPTION OF THE PREFERRED EMBODIMENT

Figure 1:
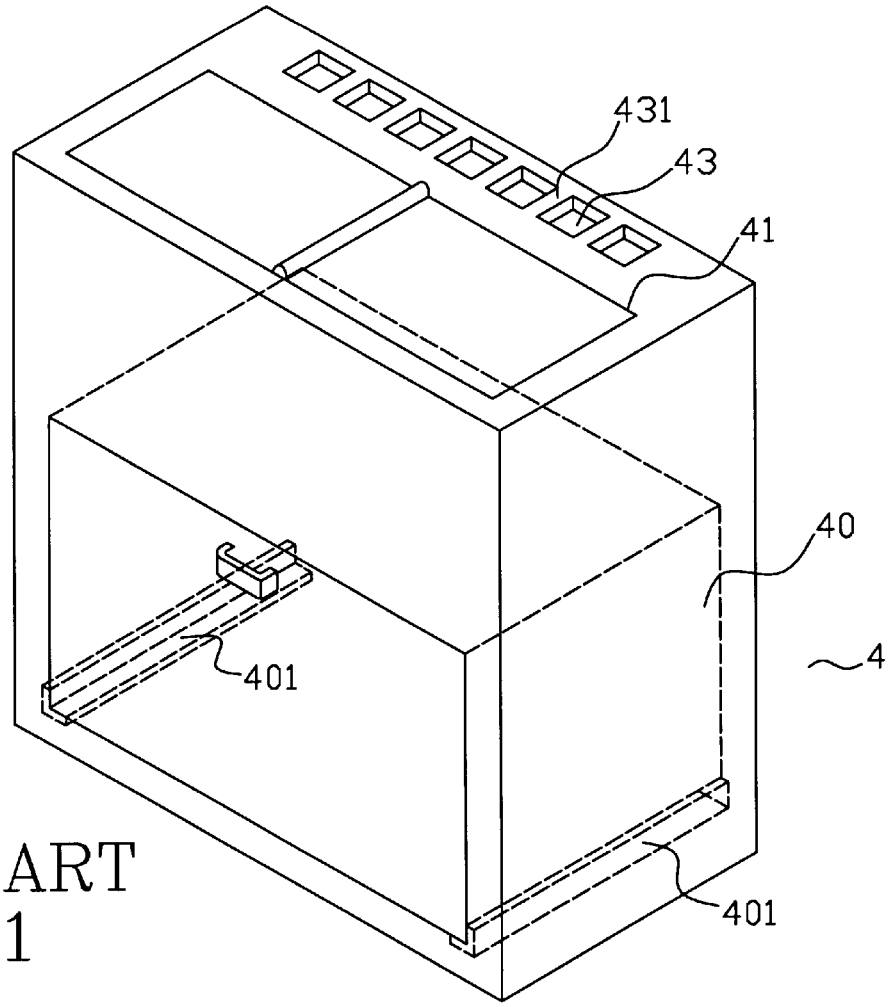
PRIOR ART FIG.1
FIGS. 1 and 1A are schematic views of the prior art.
Figure 1A:
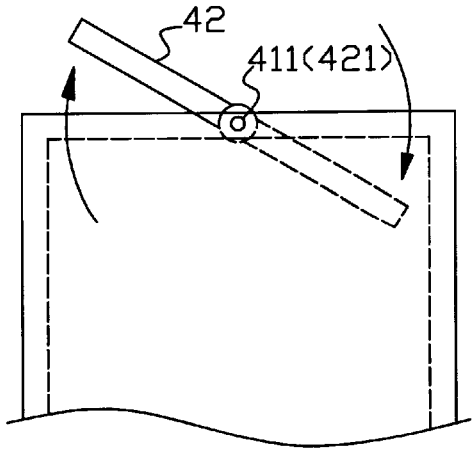
PRIOR ART FIG.1A
Figure 2:
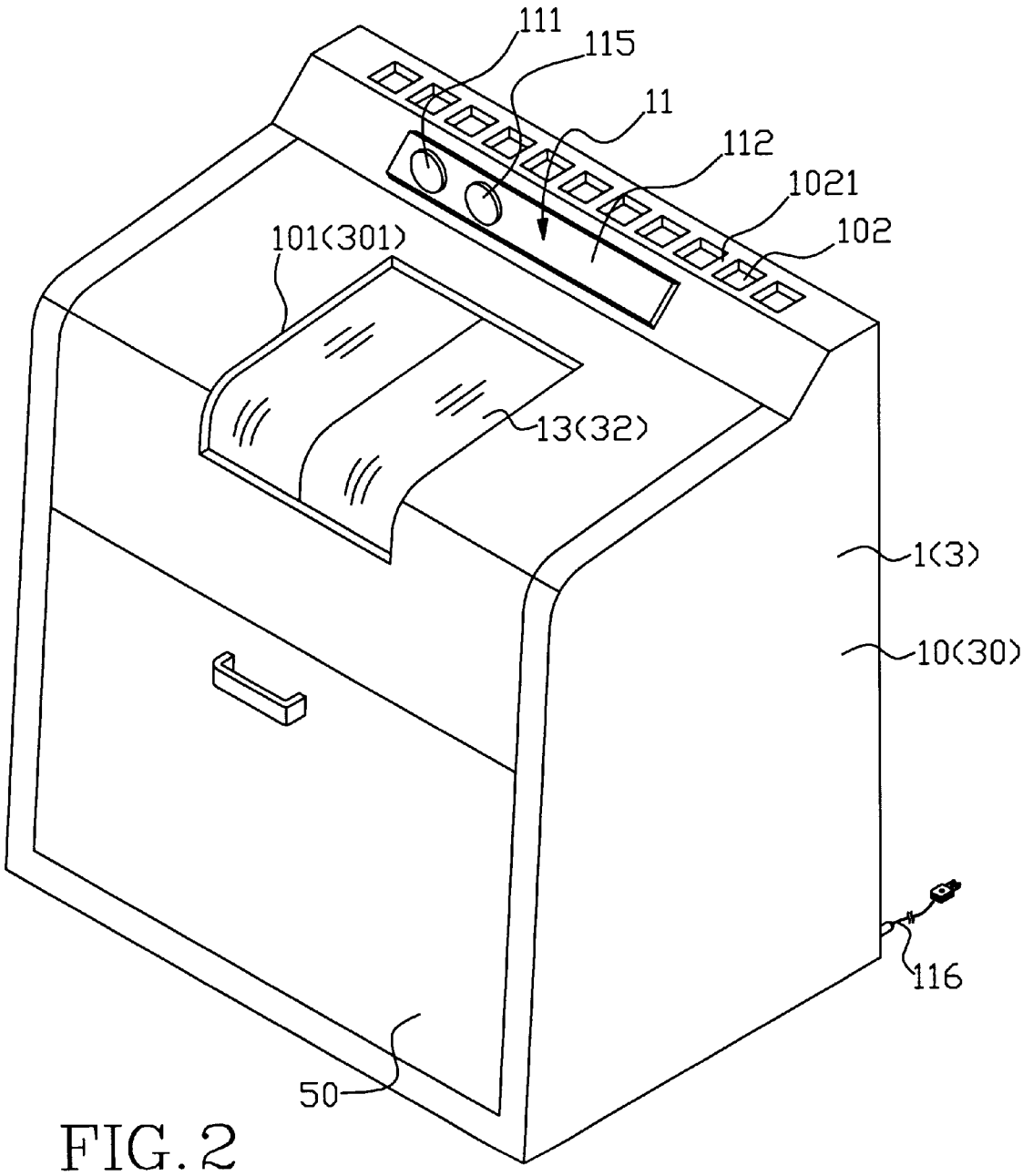
FIG. 2 is a perspective view of the first preferred embodiment of the present invention.
Figure 3:
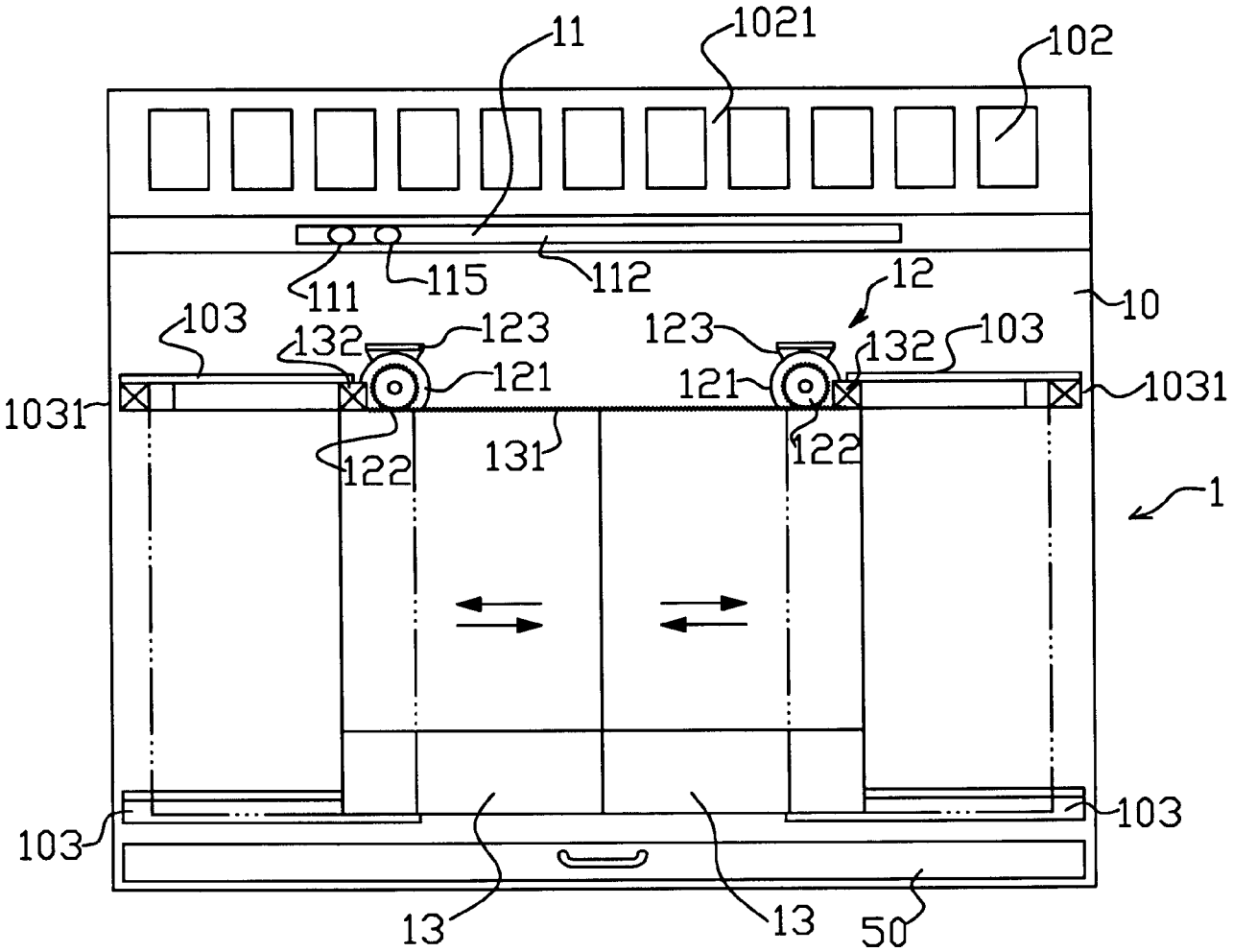
FIG. 3 is a schematic top view illustrating assembly and operation of the first preferred embodiment.
Figure 4:
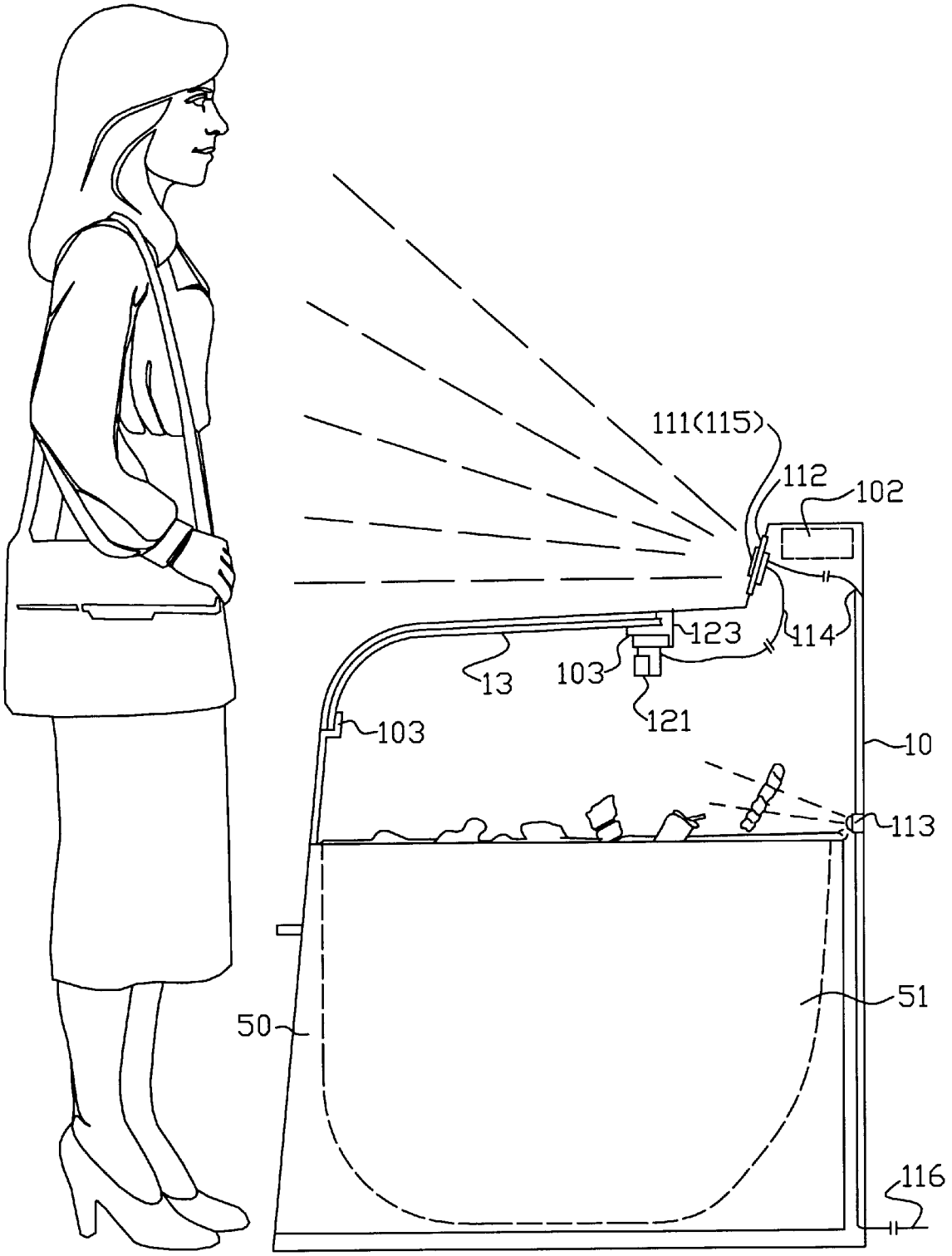
FIG. 4 is a schematic side view illustrating assembly and operation of the first preferred embodiment.

Reference is made to FIGS. 2, 3, and 4, which show the first preferred embodiment of the present invention. As shown, a gear type garbage container 1 according to the first preferred embodiment of the present invention comprises a conventional container body 10 having a garbage can 50 in a central portion. As such arrangement is not an essential feature of the present invention and is already known in the art, it will not be described in detail herein. The improvement provided by the present invention is directed to the construction of the upper portion of the container body 10. The upper side of the container body 10 is configured to have a projecting trapezoidal portion. Inside the projecting portion there is an electric control system 11. A feed slot 101 is also provided on the upper side of the container body 10 at a suitable position. Inside and below the feed slot 101 there is provided a linking-up device 12 for opening and closing the feed slot 101. The linking-up device 12 is connected to two juxtaposed cover plates 13 which together close the feed slot 101.

After installation of the electric control system 11, a control panel 112 is provided on the wider and oblique side of the projecting portion. The control panel 112 is comprised of electric control integrated circuit boards and has an electronic eye 111 and a plurality of control keys 115 disposed thereon to detect approaching objects and manual touch control. The control panel 112 further has a sensing end 113 extending to a top edge of the garbage can 50 to detect the amount of garbage. When the amount of the garbage inside the garbage can 50 has reached the sensing end 113, then the sensing end will transmit the sensed signal to the control panel to emit an alert sound to remind the user to change a garbage bag 51. The control panel 112 is further connected to the linking-up device 12 by control wires 114 extending towards the feed slot 101. The entire electric control system 11 is externally connected to electricity via a power line 116. The top end of the control panel 112 is provided with a cigarette extinguishing groove 102 having an opening partitioned by a plurality of parallel partition plates 1021 for extinguishing cigarettes. The lower portion of the feed slot 101 is provided with a pair of slide rails 103 so that the juxtaposed cover plates 13 may displace along the slide rails 103. The outer ends of the corresponding travel of the slide rails 103 are respectively provided with stop blocks 1031 to limit the travel of the cover plates 13 when opened. The linking-up device 12 is provided on the electric control system 123 below the top side of the container body 10. Essentially, two drive motors 121 and securing seats 123 are used to secure the linking-up device 12 below the top side of the container body 10, such that a transmission gear 122 on the drive motor 121 just abuts against toothed ends 131 of the cover plate s 13 for control of transmission, and the drive motors 121 are controlled by control wires 114. The cover plates 13 are inserted into the relative space of the slide rails 103 to slidably displace therein. One side of each cover plate 13 is provided with the toothed end 131 that abuts against the transmission gear 122 to provide output of transmission energy during linking-up movement. The outer edges of the toothed ends 131 of the two cover plates 13 are respectively provided with a positioning end 132 for urging against and stopping the stop blocks 1031 when the cover plates 13 are opened and at the bottom ends of their travel. When the cover plates 13 are juxtaposed in a closed state, the positioning ends 132 will touch the transmission gear 122 to a suitable extent to share part of the impact upon the cover plates 13 to reduce vibration.

Reference is made to FIGS. 3 and 4 to illustrate the present invention in actual use. When a user approaches the garbage container 10, the electronic eye 111 will sense the user within a predetermined distance. The control panel 112 then controls the drive motors 121 to open the feed slot 101. The transmission gear 122 cooperates with the toothed ends 131 of the two cover plates 13 to cause the two cover plates 13 to open so that the user may drop the garbage into the garbage container 1 within a determined distance. After the user has walked away a certain distance, the electronic eye 111 is unable to sense the presence of the user and will cause the control panel 112 to control the drive motor 131 to rotate reversely to close the feed slot 101 by driving the two cover plates 13 to their original position in a closed state. Furthermore, the sensing end 113 is located above the top edge of the garbage can 50. When the garbage has accumulated to a certain height, a buzzer of the control panel 112 will be actuated to remind workers to change the garbage bag 51. At the same time, the control panel 112 will stop actuating the cover plates 13 so that no more garbage can be dumped in. The control keys 15 are provided to allow manual control of the control panel 112 when the electronic eye 111 is not functioning. The flowchart of the entire operation can be illustrated as follows:

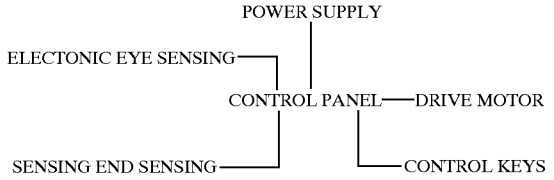

Figure 5:
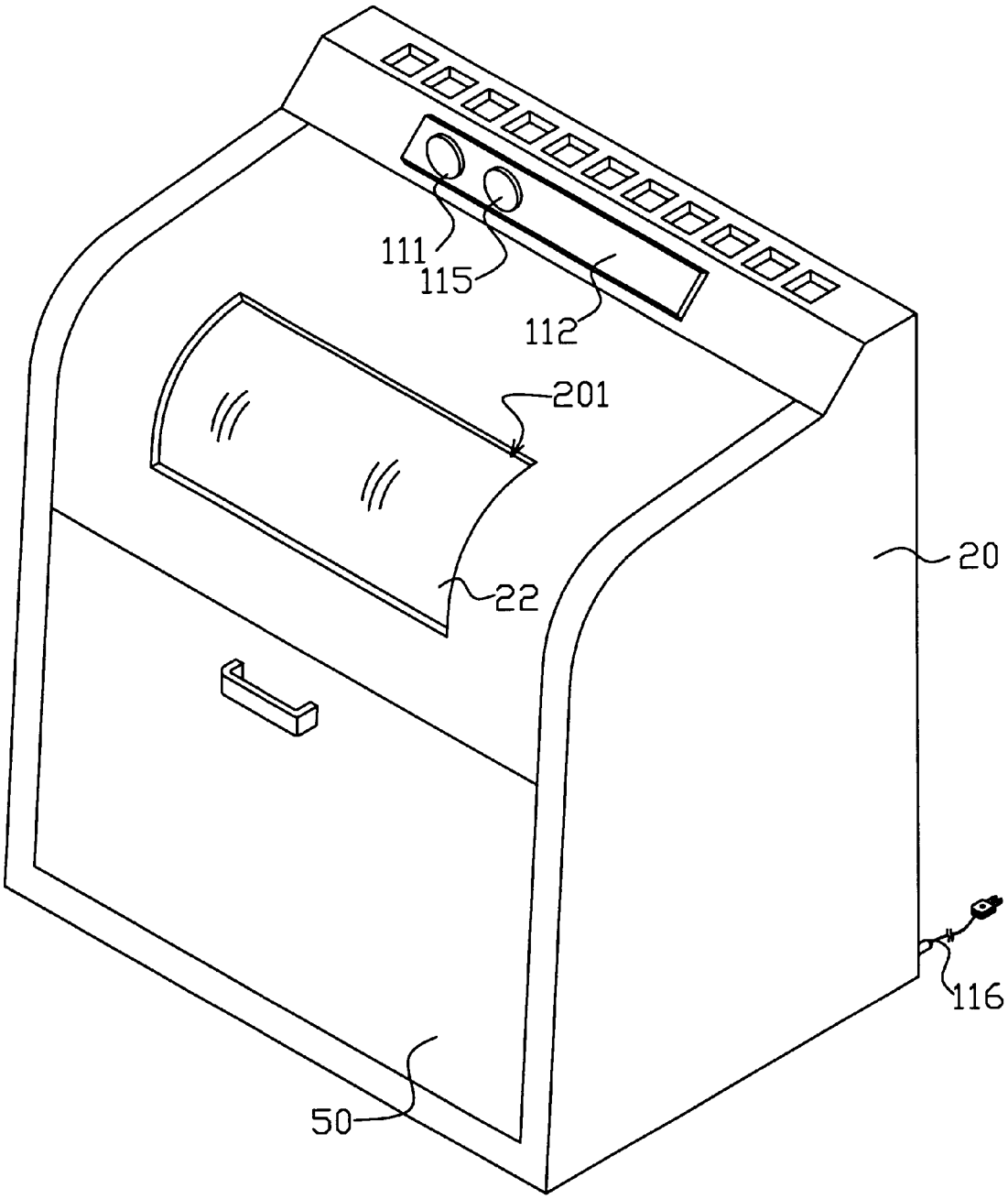
FIG. 5 is a perspective view of the second preferred embodiment of the present invention.
Figure 6:
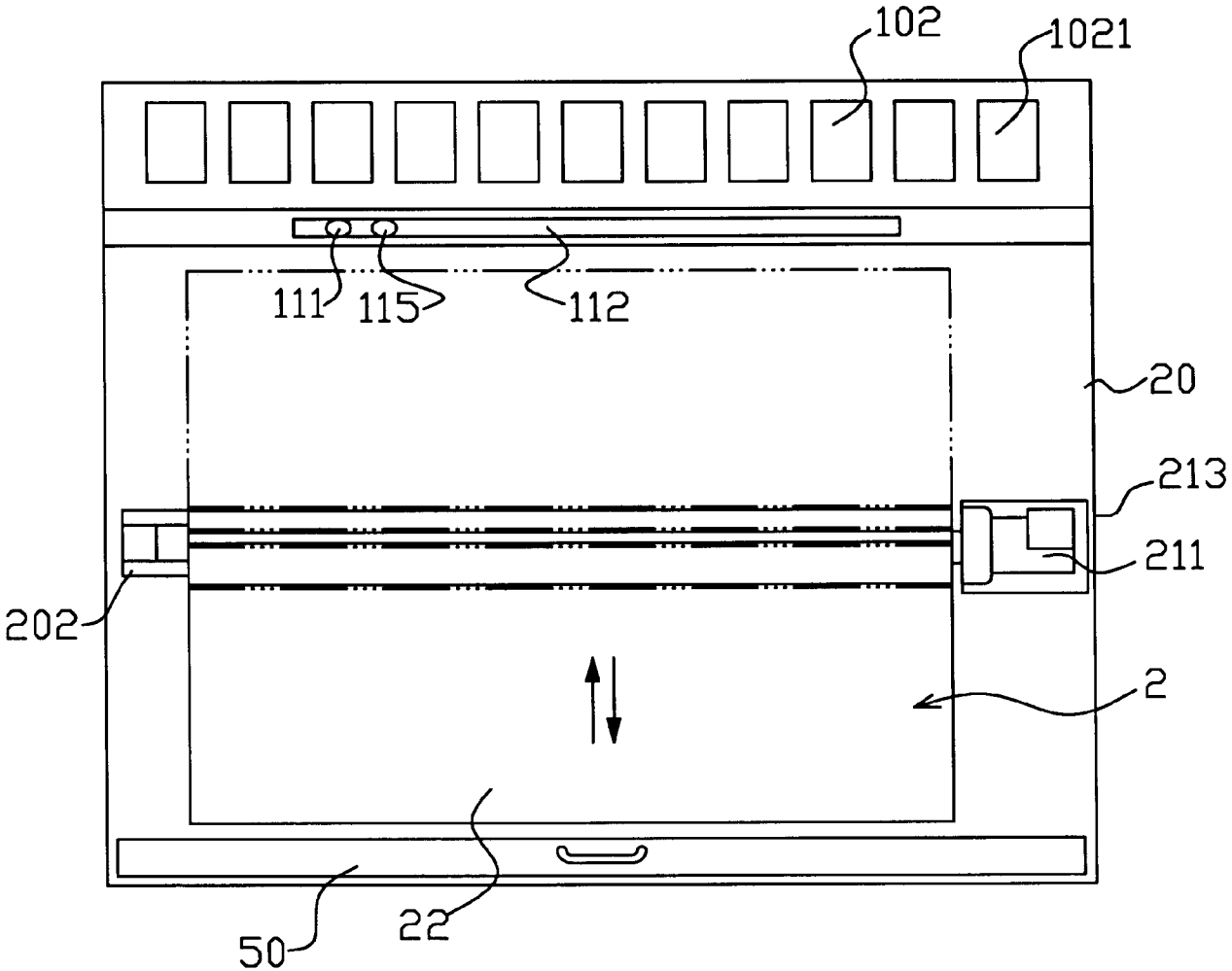
FIG. 6 is a schematic top view of the assembly and operation of the second preferred embodiment.
Figure 7:
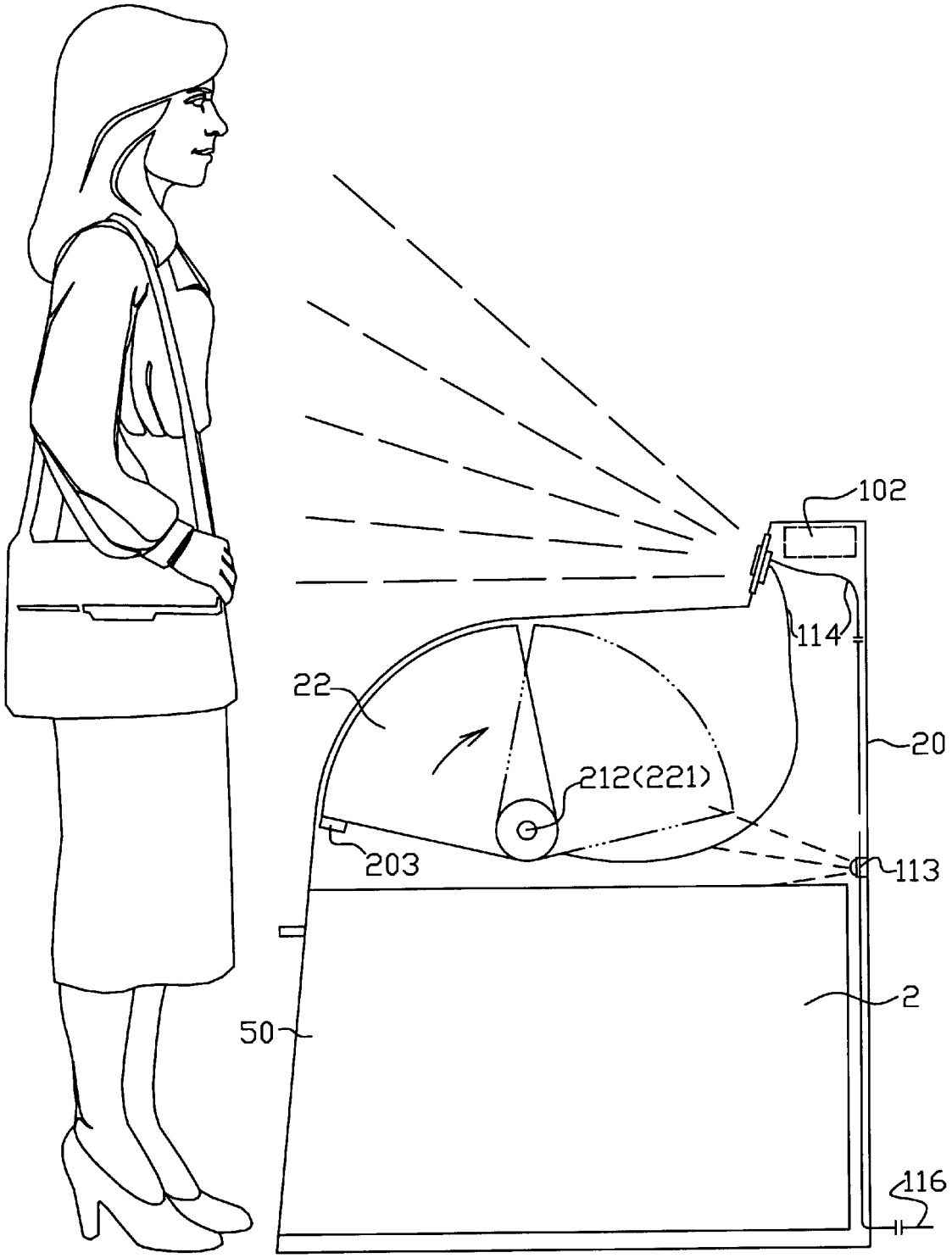
FIG. 7 is a schematic side view of the second preferred embodiment.
Figure 8:
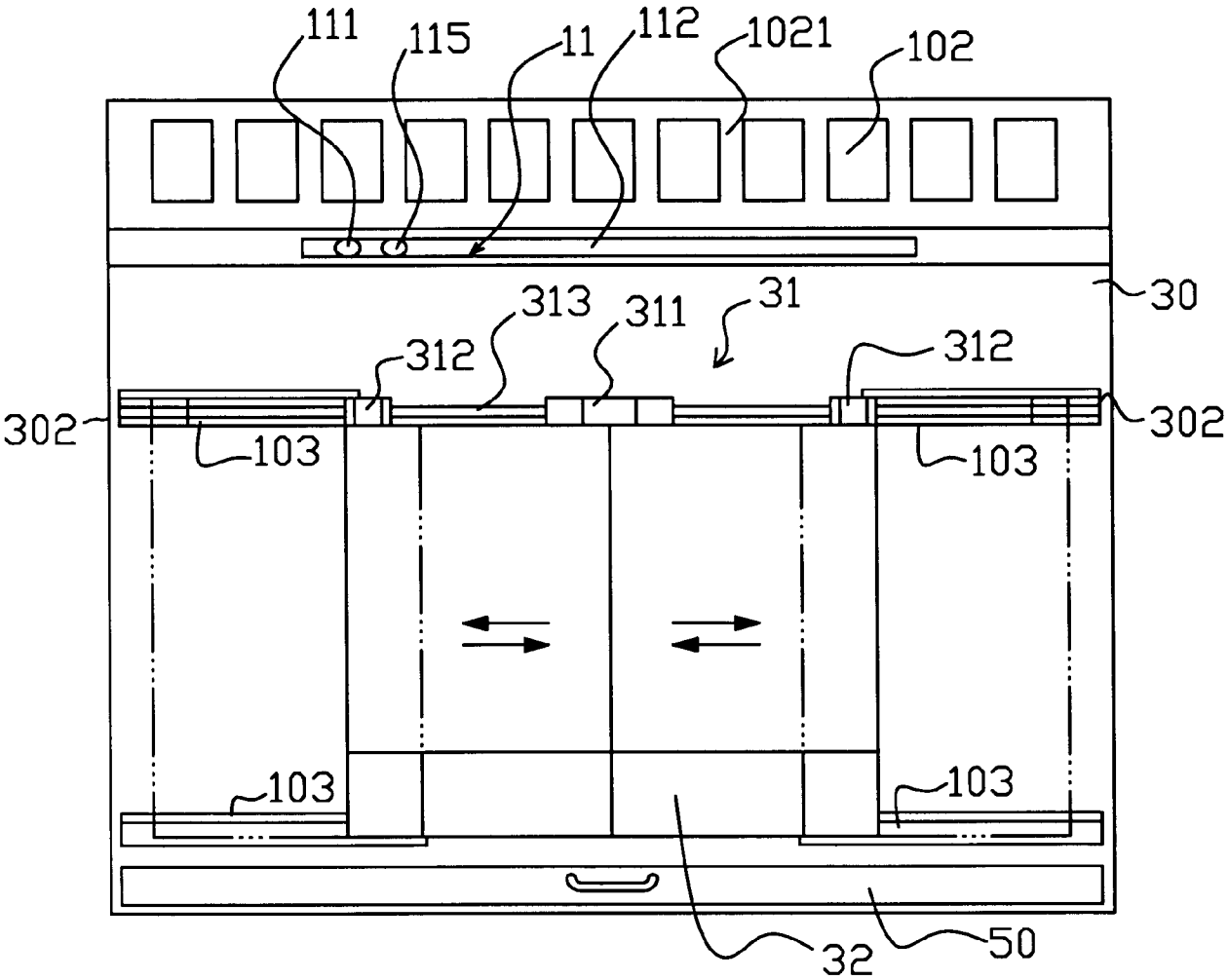
FIG. 8 is a perspective view of the third preferred embodiment of the present invention.
Figure 9:
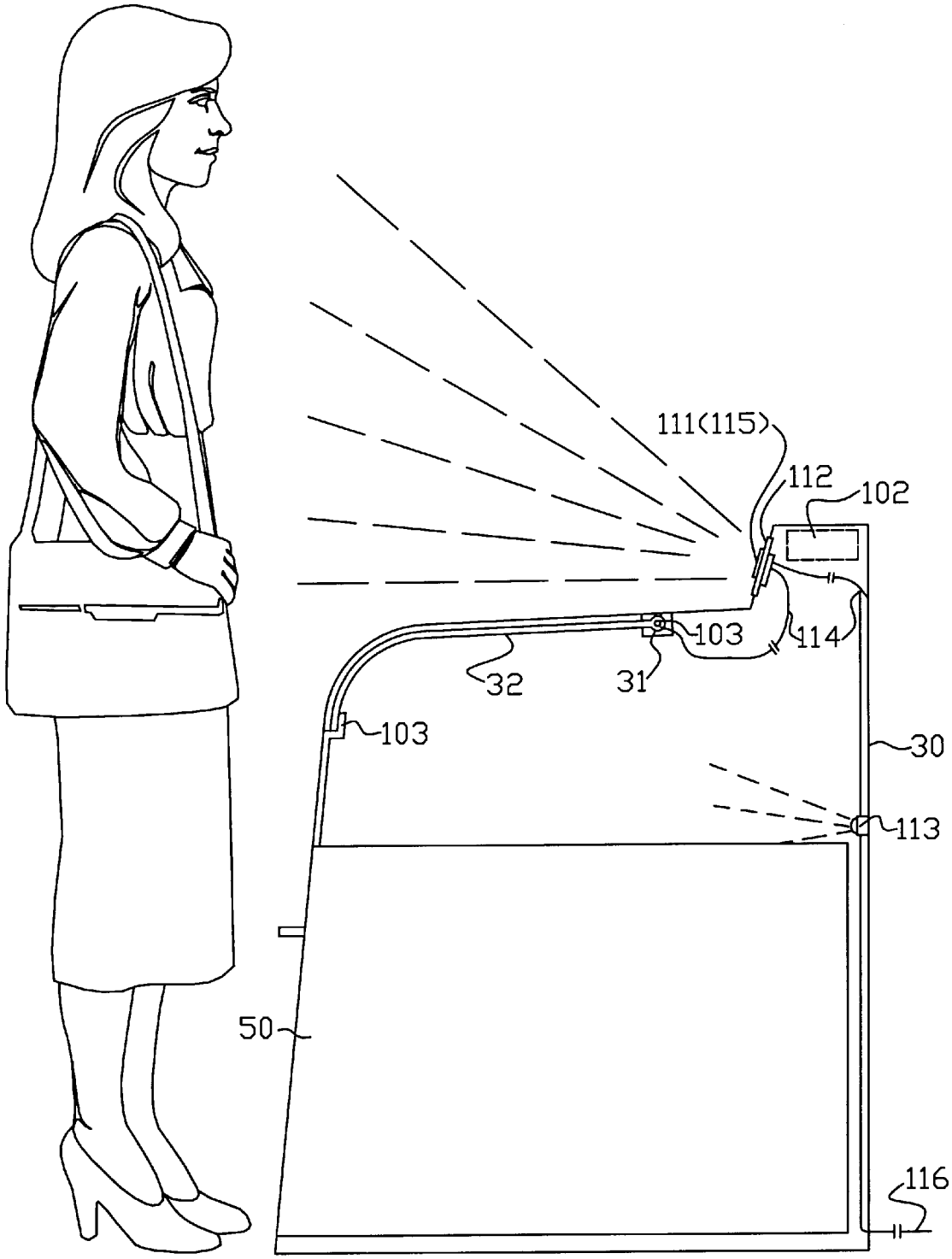
FIG. 9 is a schematic top view of the third preferred embodiment of the present invention.

Reference is made to FIGS. 5, 6, and 7, which show another preferred embodiment of the present invention. In this embodiment, the construction of the electric control system 11, and the cigarette extinguishing groove 102 remains the same. A garbage container 2 has a larger curvature, and the form of the feed slot 201 of the container body 20 and the arrangement of the linking-up device 21 and the cover plate 22 are different from the previous embodiment. The feed slot 201 is disposed at an end of the container body 20 and has a larger curvature, about ¼ of a circle, and the cover plate 22 is also curved. Distal to the feed slot 201 on one inner side wall of the container body 20, there is provided a bearing 202. The opposite side wall is provided with a securing seat 213. The bearing 202 is provided to pivotally connect to a rotary shaft 212 on one side of the curved cover plate 22, and the securing seat 213 is on the same axis as the bearing 202 to directly secure a drive motor 211 and connect to the other side of the curved cover plate 22. The inner wall of the container body 20 at the lower end of the feed slot 201 is provided with a positioning plate 203 to support the support the bottom edge of the curved cover plate 20 when it closes. The drive motor 211 is connected to the control panel via control wires 114. The curved cover plate 22 is an inverted U-shaped plate about ¼ of a circle. One side of the curved cover plate 22 is controlled by the drive motor 211 to displace about ½ of its circumference so that it can closes or opens the feed slot 201. Reference is made to FIGS. 8 and 9, which show the third preferred embodiment of the present invention. The present embodiment is modified from the gear type garbage container 1 and is an electromagnetic type garbage container 3. This embodiment is different from the previous embodiments in the manner of control of the cover plates 32. Two support holes 302 are provided on the two side walls below the feed slot 301 of the container body 30 for pivotal mounting of an electromagnetic transmission rod 313 of a linking-up system 31. The center of the electromagnetic transmission rod 313 is provided with an electromagnetic drive center 311 that cooperates with electromagnetic displacement controllers 312 on each one side of the connecting cover plates 32, whereby the cover plates 32 can be controlled by the electromagnetic displacement controllers 312 to slidably displace to open or close the feed slot 301.

In use, the present invention has the following advantages:

1. The feed slot automatically opens to avoid contact with users. As the present invention utilizes an electric control system 11, the cover plates 13, 22, 32 can be automatically opened via the linking-up device 12, 21, 31, so that users will not contact and hence contaminate their hands.

2. The cover plates can positively close the feed slots, thus preventing exposure of the garbage. The present invention utilizes precision sensing equipment and linking-up structures to control operation of the garbage container so that the garbage container can be positively closed to ensure environmental hygiene.

3. The amount of garbage inside the container can be detected to avoid overflowing of garbage. The sensing end 113 above the garbage can 50 can detect the level of garbage inside the garbage can 50 and cause the buzzer on the control panel to emit sounds and the cover plates 13, 22, 32 to stop operation, thus preventing heaping of garbage. The control keys 115 further provide manual control of the cover plates 13, 22, 32 when necessary.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An improved garbage container with automatic opening and closing functions, comprising a garbage container and a garbage can that is disposed in a central space of said garbage container, that can be pulled out of or pushed into said garbage container, and that can receive a garbage bag fitted thereon, wherein said garbage container has a projecting portion on one side, said projecting portion accommodating therein an electric control system, a top side of said garbage container being provided with a feed slot, an inner side of a bottom edge of said feed slot being provided with two cover plates, one side of said cover plates being connected to a linking-up device;

two parallel rails are provided below said feed slot for slidable displacement of said two cover plates, two side ends of opening travel of said slide rails being respectively provided with a stop block, a cigarette extinguishing groove being provided on a top edge of said projecting portion, said cigarette extinguishing groove having an opening partitioned by a plurality of partition plates;

said electric control system including a control panel that is comprised of an electronic integrated circuit board, said control panel having an electronic eye for detecting approaching objects and a plurality of manually controlled control keys provided thereon, a sensing end extending to above said garbage can for detecting the level of garbage accumulated therein, and a control wire connected to said linking-up device for driving said cover plates;

said cover plates are juxtaposed and disposed in a relative space of said slide rails so that they can relatively slidably displace, said cover plates being provided with toothed ends on side ends that correspond to said electric control system for abutting against a transmission device, the outer sides of the toothed ends being respectively provided with a positioning end, said positioning ends displacing outwardly to a bottom end of the travel to abut against said stop blocks for positioning purposes, and abutting against a transmission portion of said transmission device during return travel, said transmission device including two drive motors secured by securing seats below inner edges of the top side of said container body, a transmission end thereof being provided with a transmission gear that engages said toothed ends of said cover plates for transmission purposes and that is connected to said control panel via control wires;

whereby when said electronic eye detects an approaching user, it sends a signal to said control panel which drives said transmission device to cause said cover plates to open or close said feed slot, so that the user needs not touch said garbage container when dumping garbage, and when said sensing end detects that the level of garbage inside said garbage can has reached a determined level, it sends a signal to said control panel to emit an alert sound, and said control panel hence prohibits opening of said cover plates to avoid over-dumping of garbage, said control keys being provided to allow manual operation of said cover plates when necessary.

2. An improved garbage container with automatic opening and closing functions as claimed in claim 1, wherein said feed slot may be disposed on the top side of said container body or may extend in the form of a curve to one side of said container body to increase the size thereof.

3. An improved garbage container with automatic opening and closing functions as claimed in claim 1, wherein said cover plates match the shape of said feed slot to perform opening or closing of said feed slot.

4. An improved garbage container with automatic opening and closing functions as claimed in claim 1, wherein said feed slot is disposed on one side of the top side of said container body in the form of a curve about ¼ of a circle, and said cover plates are an inverted U-shaped cover that corresponds to said feed slot, one side of said cover plate utilizing a rotary shaft to pivotally connect to a bearing on said container body, the other end thereof being connected to said drive motors and said securing seats to perform co-axial rotation, so that said curved cover plate can perform rotation of ½ of a circle to achieve opening or closing of said feed slot, said container body further having a positioning plate on a vertical bottom travel of the turning of said cover plate for supporting the bottom end of said cover plate during closing.

5. An improved garbage container with automatic opening and closing functions as claimed in claim 1, wherein the cooperation of said transmission device and said cover plates may utilize an electromagnetic drive center in cooperation with an electromagnetic transmission rod pivotally disposed on said container body, said electromagnetic transmission rod being provided with two electromagnetic displacement controllers for connection to said cover plates, said electromagnetic controllers being driven by said electromagnetic drive center to cause said cover plates to open or close.

* * * * *